US006050416A

United States Patent [19]

Blin et al.

[11] Patent Number: 6,050,416

[45] Date of Patent: Apr. 18, 2000

[54] DISPLAY PACKAGE

[75] Inventors: Patrick Blin; Jean-Michel Auclair, both of Chateauroux, France

[73] Assignee: The Mead Corporation, Dayton, Ohio

[21] Appl. No.: 09/155,774

[22] PCT Filed: Apr. 1, 1997

[86] PCT No.: PCT/US97/05326

§ 371 Date: Oct. 1, 1998

§ 102(e) Date: Oct. 1, 1998

[87] PCT Pub. No.: WO97/36792

PCT Pub. Date: Oct. 9, 1997

[30] Foreign Application Priority Data

Apr. 1, 1996 [GB] United Kingdom ..... 9606878

[51] Int. Cl.[7] ..... B65D 5/4805; B65D 75/58

[52] U.S. Cl. ..... 206/469; 206/461; 206/705; 229/120.15

[58] Field of Search ..... 206/705, 775, 206/806, 461, 469; 229/120.09, 120.11, 120.15, 120.18, 161, 162

[56] References Cited

U.S. PATENT DOCUMENTS

| | | | |
|---|---|---|---|
| 1,791,094 | 2/1931 | Albert | 229/162 |
| 1,837,012 | 12/1931 | Boeye . | |
| 1,965,215 | 7/1934 | Boeye | 206/333 |
| 2,018,861 | 10/1935 | Mertz | 206/488 |
| 2,397,041 | 3/1946 | Pantalone | 206/334 |
| 2,822,917 | 2/1958 | Toensmeier | 206/45.31 |
| 2,913,101 | 11/1959 | Daily | 206/45.19 |
| 2,983,368 | 5/1961 | Vander Lugt, Jr. | 206/45.14 |
| 3,114,474 | 12/1963 | Davis | 229/120.15 |
| 3,233,726 | 2/1966 | Gero | 206/45.31 |
| 3,424,306 | 1/1969 | Munck | 206/333 |
| 4,114,796 | 9/1978 | Voges | 229/120.15 |
| 4,323,156 | 4/1982 | Grueneberg | 206/333 |
| 4,487,311 | 12/1984 | Lavery | 206/45.31 |
| 4,601,390 | 7/1986 | Rosenthal et al. | 206/175 |
| 4,641,746 | 2/1987 | Dornbusch et al. | 206/602 |
| 4,696,402 | 9/1987 | Harmon et al. | 206/333 |
| 4,784,266 | 11/1988 | Chaussadas | 206/434 |
| 5,379,894 | 1/1995 | Haas et al. | 206/333 |

FOREIGN PATENT DOCUMENTS

| | | | |
|---|---|---|---|
| 980304 | 12/1975 | Canada . | |
| 0531654 | 3/1993 | European Pat. Off. . | |
| 0 453 240 | 11/1995 | European Pat. Off. . | |
| 1542575 | 10/1968 | France | 206/332 |
| 4405993 | 8/1995 | Germany | 206/175 |
| 22922 | 8/1961 | Ireland . | |
| 1173863 | 12/1969 | United Kingdom . | |
| 2100231 | 12/1982 | United Kingdom . | |

*Primary Examiner*—Jim Foster

[57] ABSTRACT

A display package (95) for articles such as batteries includes a hollow display box in which one or more articles are secured, the box having an interconnected display face (16), end walls (22, 26) and back panel (20), and a hanging support panel (12) extending above the box and substantially coplanar with the back panel, a display window (C1) created in the display face by displacing into the hollow box a portion of the display face and a portion of the end wall, whereby the display face portion provides an internal partition (96) connecting the display face with said back panel.

17 Claims, 12 Drawing Sheets

DISPLAY PACKAGE

This invention relates to a display package adapted to accomodate a plurality of articles such as batteries and to a blank for forming the carrier. More particularly the invention relates to a display package with dividing cells to secure the articles in an array.

The problems associated with cartons of this type are that the articles must be prevented from being individually removed from a multiple pack while at the same time displaying the articles. In addition, articles of this type require means to allow the unit to be hung, so the panels need to be of sufficient thickness to provide necessary support. This invention seeks to mitigate these problems.

One aspect of the invention provides a display package for articles such as batteries which package comprises a hollow display box in which one or more articles are secured, the box having an interconnected display face, back panel, a hanging support panel extending above the box and substantially coplanar with said back panel an end wall connected to a side edge of said display face, by first hingable means, a display window created in said display face and said end wall by displacing a portion of said display face and a portion of said end wall connected together by second hingable means, whereby said display face portion provides at least a part of an internal partition interposed between said display face and sad back panel and having a comer defined by said second hingable means and wherein said second hingable means is offset from said first hingable means when said package is in blank form.

According to an optional feature of this aspect of the invention, said first and second hingable means nay be first and second fold lines, respectively.

According to another optional feature of this aspect of the invention, said first hingable means may comprise a first bevelled corner panel and wherein said second hingable means comprises a second bevelled comer panel.

Preferably, at least one article is accommodated in each of said windows.

According to another optional feature of this aspect of the invention, said back panel and said hanging support panel are formed from a single panel.

According to another optional feature of this aspect of the invention, said displaced end wall portion may be secured to the back panel.

According to yet another optional feature of this aspect of the invention, the display package may comprise a plurality of like display windows divided from each other by a portion of the display face.

According to further optional feature of this aspect of the invention, the dividing portion of the display face may comprise hinged tabs which are displaceable out of the plane of said display face to provide a further window in the display face in which an article is accommodated.

In a second aspect of the invention there is provided a blank for forming a display package for articles such as batteries, the blank comprising an interconnected series of panels including front support panel, top panel, display face panel, bottom panel and rear support panel, an end panel connected to a side edge of said display face panel by first hingable means, and means for creating a display window in said display face panel including first and second displaceable portions interconnected by second hingable means, whereby said first displaceable portion provides at least a part of an internal partition interposed between said display face panel and said rear support panel when the blank is erected to form the package and wherein said second hingable means is offset from said first hingable means to define a corner of said internal partition.

Optionally, the first hingable means may comprise a first bevelled comer panel and wherein said second hingable means comprises a second bevelled comer panel.

According to another optional features the blank may further comprise a strengthening panel connected at the outer edge of said end panel.

According to yet another optional feature of the second aspect of the invention said rear support panel is of a length great than said display face. Preferably, sad rear support panel may be of a length generally equal to the combined length of said display face and said front support panel.

According to a further optional feature of the second aspect of the invention, the blank may comprise a plurality of like display window creating means connected together by a portion of the display face.

According to a further optional feature of the second aspect of the invention, the connecting portion of the display face may comprise hinged tabs which are displaceable out of the plane of the display face panel.

According to another optional feature of the second aspect of the invention, said first displaceable portion may be formed at least in part from said display face panel, and said second displaceable portion is formed at least in part from said end panel.

A third aspect of the invention provides a method of forming a display package from a blank which method comprises the steps of erecting the internal partition by displacing, said first and second displaceable portions to define a cell for receiving one or more articles, inserting said one or more articles into the cell, and folding the rear support panel, bottom panel, top panel and front support panel to construct a hollow display box.

Embodiments of this invention will now be described, by way of example only, with reference to the accompanying drawings in which.

Figure 1:
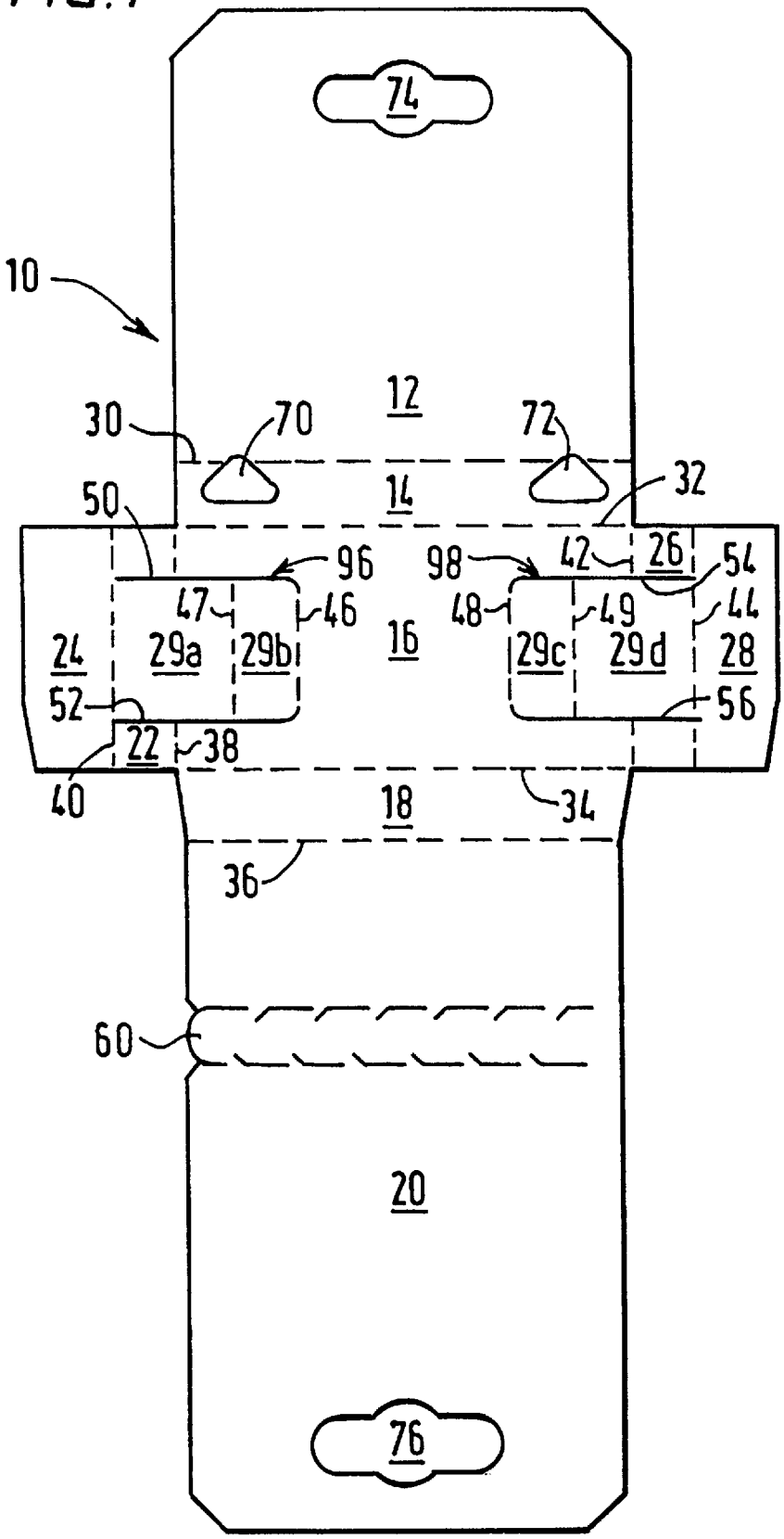
FIG. 1 is a plan view of the carton blank according to one aspect of the invention.

Referring to FIG. 1 there is a shown a carton blank (10) made from paperboard or similar foldable sheet material. The blank comprises a series of panels hinged one to the next. Thus, support panel (12) is hingably connected to top panel (14) along fold line (30) thereby enabling panels (12, 14) to be placed in a substantially perpendicular relationship. Top panel (14) is connected by way of fold line (32) to side panel (16), thereby enabling panels (14, 16) to be placed in a substantially perpendicular relationship. Side panel (16) is hingably connected along fold line (34) to bottom panel (18) thereby enabling panels (16, 18) to be placed in a substantially perpendicular relationship such that top panel (14) and bottom panel (18) form opposing sides in a set up carton. Base panel (18) is hingably connected to support panel (20) by means of fold line (36) thereby enabling panels (18, 20) to be plated in a substantially perpendicular relationship. In a set up condition, support panels (12, 20) are connected together in a face to face relationship by glue or other suitable means.

End panel (22) is hingably connected to side panel (16) along fold (38) and strengthening panel (24) is hingably connected by means of fold line (40) to the opposing side of end panel (22). Likewise, end panel (26) is hingably connected to side panel (16) along fold line (42) and strengthening panel (28) is hingably connected to the opposing side of end panel (26) along fold line (44).

In a set up condition, top panel (14), side panel (16), bottom panel (18) and a portion of support panel (20) cooperate to form a hollow display box. End panels (22, 26) provide closures for the box, with strengthening panels (24, 28) being secured, such as by gluing, to support panel (20) to maintain the box in set up condition. Side panel (16) provides a display face for the package, while support panel (20) provides a back panel. As explained herein, support panels (12, 20) together cooperate to provide the panel from which the package may be hung.

Figure 2:
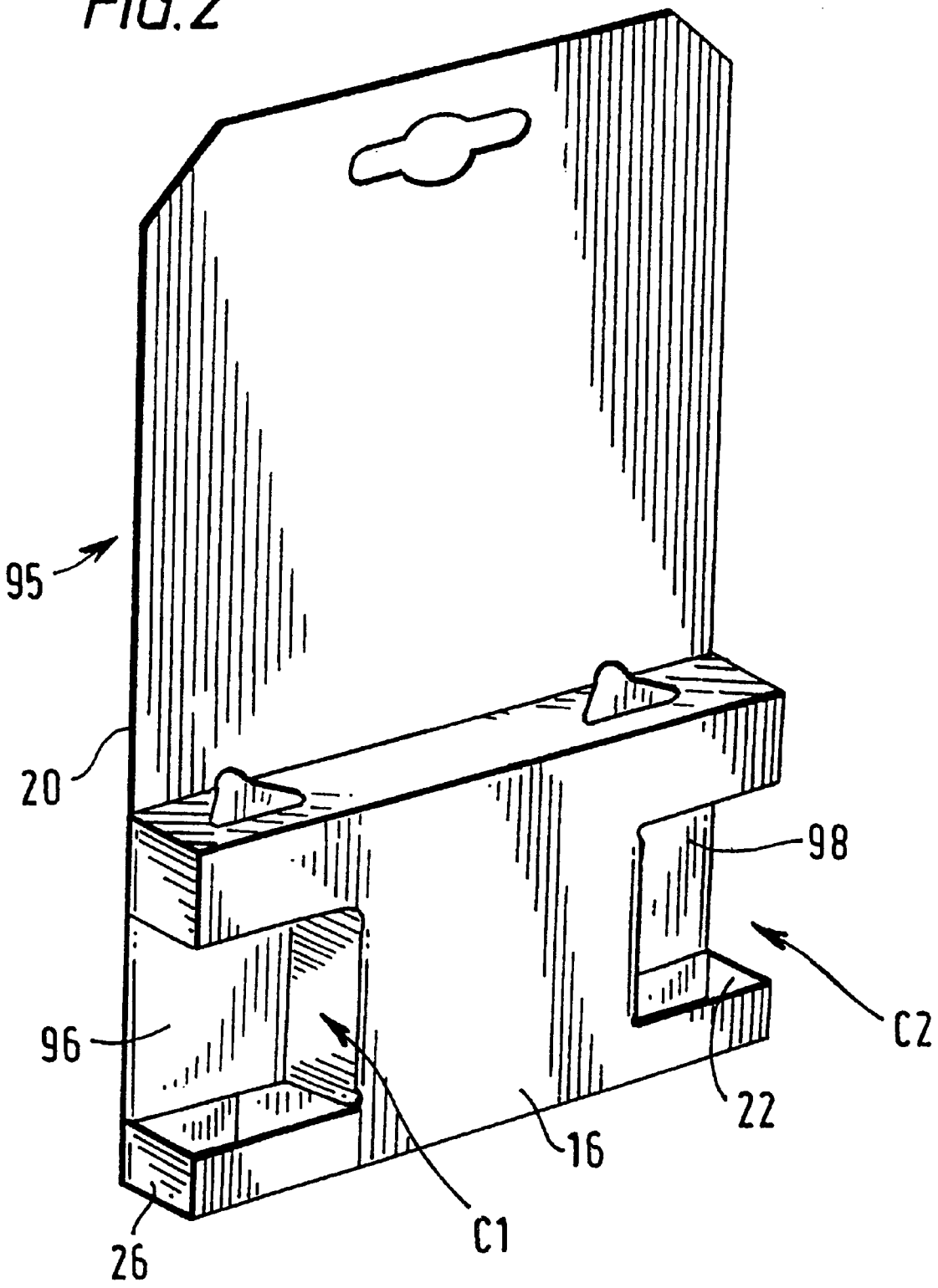
FIG. 2 is a perspective view of a carton formed from the blank as shown in FIG. 1.

The carton incorporates two securing cells or display windows (C1, C2) constructed from partition sections (96, 98) as illustrated in FIG. 2. As shown in FIG. 1, partition section (96) is struck from side panel (16) and end panel (22) along opposing cut lines (50, 52). Partition section (96) is hinged to side panel (16) along fold line (46) and hinged to strengthening panel (24) along fold line (40). When the carton is in a set up condition, this partition section will define an individual cell. Turning in more detail to partition section (96), this section comprises inner side panel (29*a*) and inner support panel (29*b*) hingably connected together along fold line (47).

Partition section (98) is struck from side panel (16) and end panel (26) along opposing cut lines (54, 56). Partition section (98) is hinged to side panel (16) along fold line (48) and hinged to strengthening panel (28) along fold line (44). When the carton is in a set up condition this partition section will define an individual cell. Turning in more detail to partition section (98), this section comprises inner support panel (29*c*) and inner side panel (29*d*) hingably connected together along fold line (49).

In order to form the carton illustrated in FIG. 2, partition section (96) is moved out of alignment with side panel (16) by folding end panel (22), inner support panel (29*b*) and inner side panel (29*a*) along fold lines (38, 40, 46, 47). Likewise, partition section (98) is moved out of alignment with side panel (16) by folding end panel (26), inner side panel (29*a*) and inner support panel (29*c*) along fold lines (42, 44, 48, 49). In this embodiment, inner side panels (29*a*, 29*d*) are positioned in a plane substantially parallel to side panel (16) and spaced therefrom by end panels (22, 29*b* and 26, 29*c*) respectively, thus forming securing cells (C1, C2) illustrated in FIG. 2.

The articles are introduced into the cells and strengthening panel (24) is folded along fold line (40) into a substantially perpendicular relationship with end panel (22). Strengthening panel (28) is also folded along fold line (44) into a perpendicular relationship with corresponding end panel (26). Strengthening panel (24, 28) are thus brought into a face to face relationship with partition sections (96, 98) respectively and are connected thereto by glue or other suitable means.

Top panel (14) is folded along fold line (32) into a substantially perpendicular relationship with side panel (16) such that apertures (70, 72) are used to secure top portions of said articles (not shown). Base panel (18) is folded along fold line (34) into a substantially perpendicular relationship with side panel (16). Thus, panels (14, 18) are oppositely disposed so as to enclose each cell.

Support panel (20) is folded along fold line (36) into a substantially perpendicular relationship with base panel (18) and forms a face to face relationship with inner side panels (29*a*, 29*d*). Support panel (12) is folded along fold line (30) into a substantially perpendicular relationship with top panel (14) so that it forms a face to face relationship with support panel (20) and apertures (74, 76) are in alignment.

In a set up condition, the articles are retained within the cells of the carton and can be partially viewed through the display window aperture created when partition sections (96, 98) are moved out of alignment with side panel (16) and corresponding end panels (22, 26).

Optionally, tab (60) is frangibly connected to a central portion of support panel (20). In use, this tab facilitates access to the articles retained within the cells and apertures (74, 76) allow the carrier to be hung from a hook or other suitable means.

Figure 3:
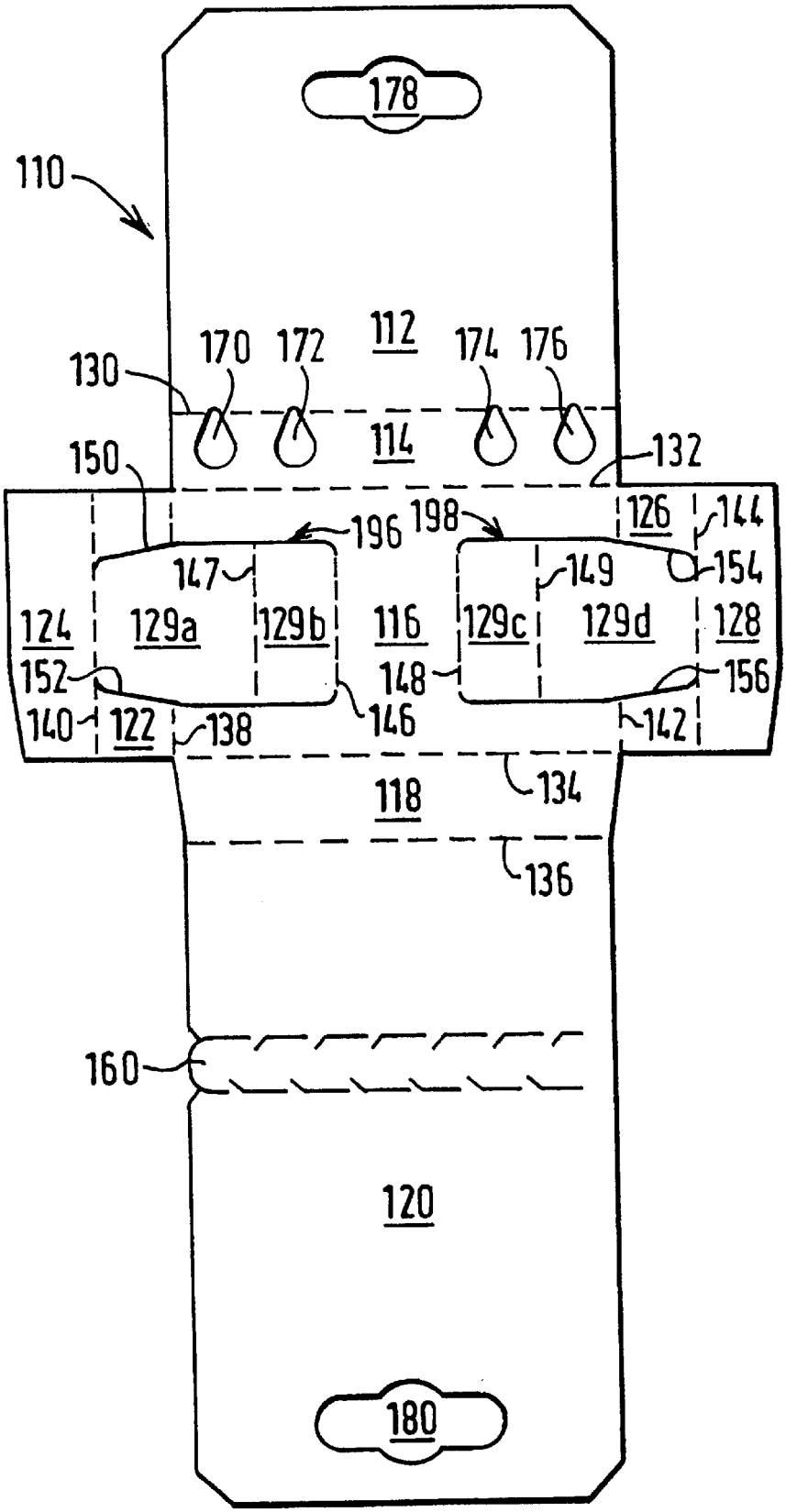
FIG. 3 is a plan view of a carton blank according to another embodiment of the invention.

Referring to FIG. 3 there is a shown a carton blank (110) made from paperboard or similar foldable sheet material. The blank comprises a series of panels hinged one to the next. Thus, support panel (112) is hingably connected to top panel (114) along fold line (130) thereby enabling panels (112, 114) to be placed in a substantially perpendicular relationship. Top panel (114) is connected by way of fold line (132) to side panel (116), thereby enabling panels (114, 116) to be placed in a substantially perpendicular relationship. Side panel (116) is hingably connected along fold line (134) to bottom panel (118) thereby enabling panels (116, 118) to be placed in a substantially perpendicular relationship such that top panel (114) and bottom panel (118) form opposing sides in a set up carton. Base panel (118) is hingably connected to support panel (120) by means of fold line (136) thereby enabling panels (118, 120) to be placed in a substantially perpendicular relationship. In a set up condition, support panels (112, 120) are connected together in a face to face relationship by glue or other suitable means.

End panel (122) is hingably connected to side panel (116) along fold (138) and strengthening panel (124) is hingably connected by means of fold line (140) to the opposing side of end panel (122). Likewise, end panel (126) is hingably connected to side panel (116) along fold line (142) and strengthening panel (128) is hingably connected to the opposing side of end panel (126) along fold line (144).

In a set up condition, top panel (114), side panel (116), bottom panel (118) and a portion of support panel 120 cooperate to form a hollow display box. End panels (122, 126) provide closures for the box, with strengthening panels (124, 128) being secured, such as by gluing, to support panel (120) to maintain the box in set up condition. Side panel (116) provides a display face for the package, while support panel (120) provides a back panel. As explained herein, support panels (112, 120) together cooperate to provide the panel from which the package may be hung.

Figure 4:
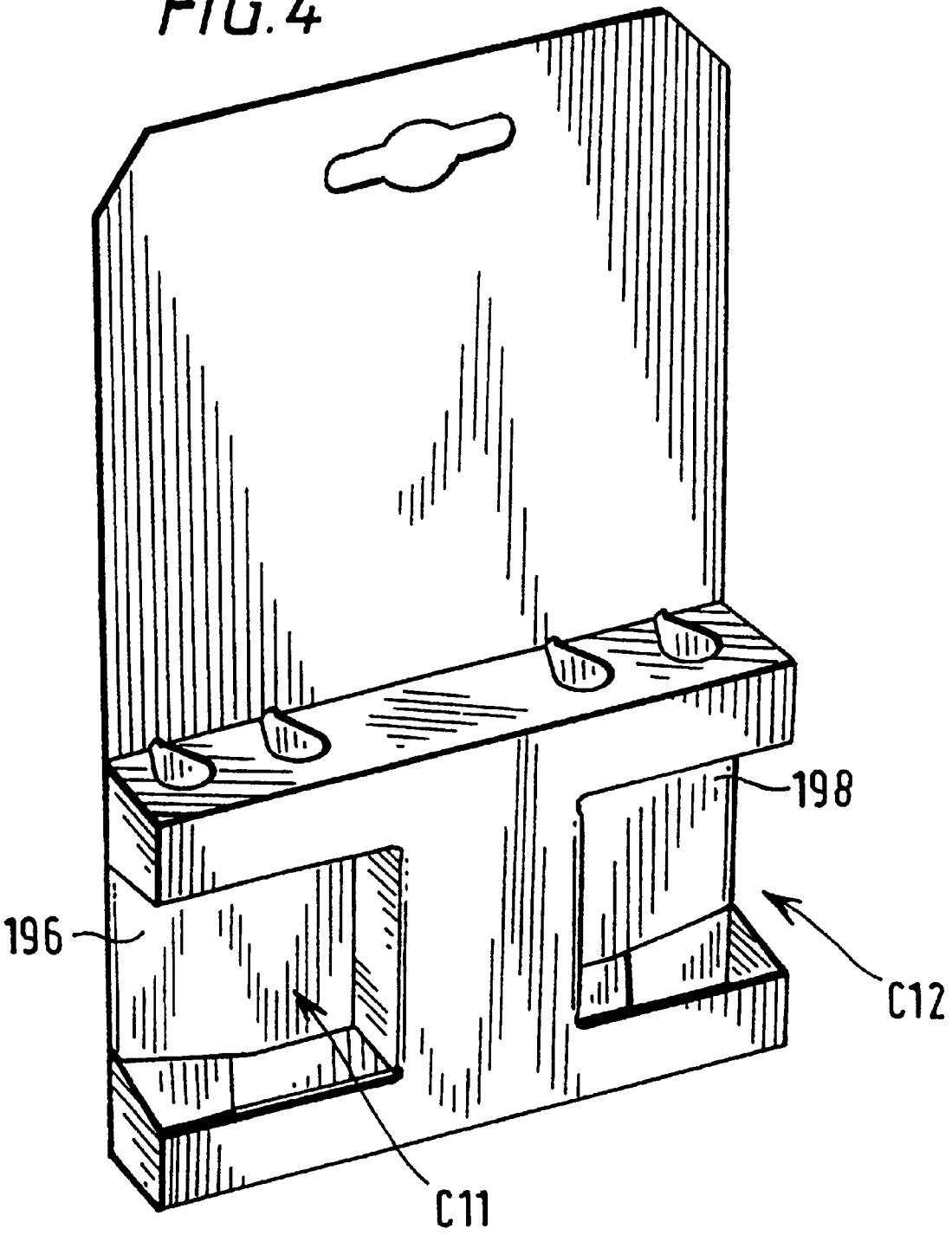
FIG. 4 is a perspective view of a carton formed from the blank shown in FIG. 3.

The carton incorporates two securing cells or display windows (C11, C12) constructed from partition sections (196, 198) as illustrated in FIG. 4. As shown in FIG. 3, partition section (196) is struck from side panel (116) and end panel (122) along opposing cut lines (150, 152). Partition section (196) is hinged to side panel (116) along fold line (146) and hinged to strengthening panel (124) along fold line (140). When the carton is in a set up condition, this partition section will define an individual cell. Turning in more detail to partition section (196), this section comprises inner side panel (129*a*) and inner support panel (129*b*) hingably connected together along fold line (147).

Partition section (198) is struck from side panel (116) and end panel (126) along opposing cut lines (154, 156). Partition section (198) is hinged to side panel (116) along fold line (148) and hinged to strengthening panel (128) along fold line (144). When the carton is in a set up condition this partition section will define an individual cell. Turning in more detail to partition section (198), this section comprises inner support panel (129*c*) and inner side panel (129*d*) hingeably connected together along fold line (148).

In order to form the carton illustrated in FIG. 4, partition section (196) is moved out of alignment with side panel (116) by folding end panel (122), inner support panel (129*b*) and inner side panels (129*a*) along fold lines (138, 140, 146, 147). Likewise, partition section (198) is moved out of alignment with side panel (116) by folding end panel (126), inner side panel (129*d*) and inner support panel (129*c*) along fold lines (142, 144, 148, 149). In this embodiment, inner side panels (129*a*, 129*d*) are positioned in a plane substantially parallel to side panel (116) and spaced therefrom by end panels (122, 129*b* and 126, 129*c*) respectively, thus forming securing cells (C11, C12) illustrated in FIG. 4.

The articles are introduced into the cells and strengthening panel (124) is folded along fold line (140) into a substantially perpendicular relationship with end panel (122). Strengthening panel (128) is also folded along fold line (144) into a perpendicular relationship with corresponding end panel (126). Strengthening panels (124, 128) are thus brought into a face to face relationship with partition sections (196, 198) respectively and are connected thereto by glue or other suitable means.

Top panel (114) is folded along fold line (132) into a substantially perpendicular relationship with side panel (116) such that apertures (170, 172, 174, 176) are used to secure top portions of said articles (not shown). Base panel (118) is folded along fold line (134) into a substantially perpendicular relationship with side panel (116). Thus, panels (114, 118) are oppositely disposed so as to enclose each cell.

Support panel (120) is folded along fold line (136) into a substantially perpendicular relationship with base panel (118) and forms a face to face relationship with inner side panels (129*a*, 129*d*). Support panel (112) is folded along fold line (130) into a substantially perpendicular relationship with top panel (114) so that it forms a face to face relationship with support panel (120) and apertures (178, 180) are in alignment.

In a set up condition, the articles are retained within the cells of the carton and can be partially viewed through the display window apertures created when partition sections (196, 198) are moved out of alignment with side panel (116) and corresponding end panels (122, 126).

Optionally, tab (160) is frangibly connected to a central portion of support panel (120). In use, this tab facilitates access to the articles retained within the cells and apertures (178, 1780) allow the carrier to be hung from a hook or other suitable means.

Figure 5:
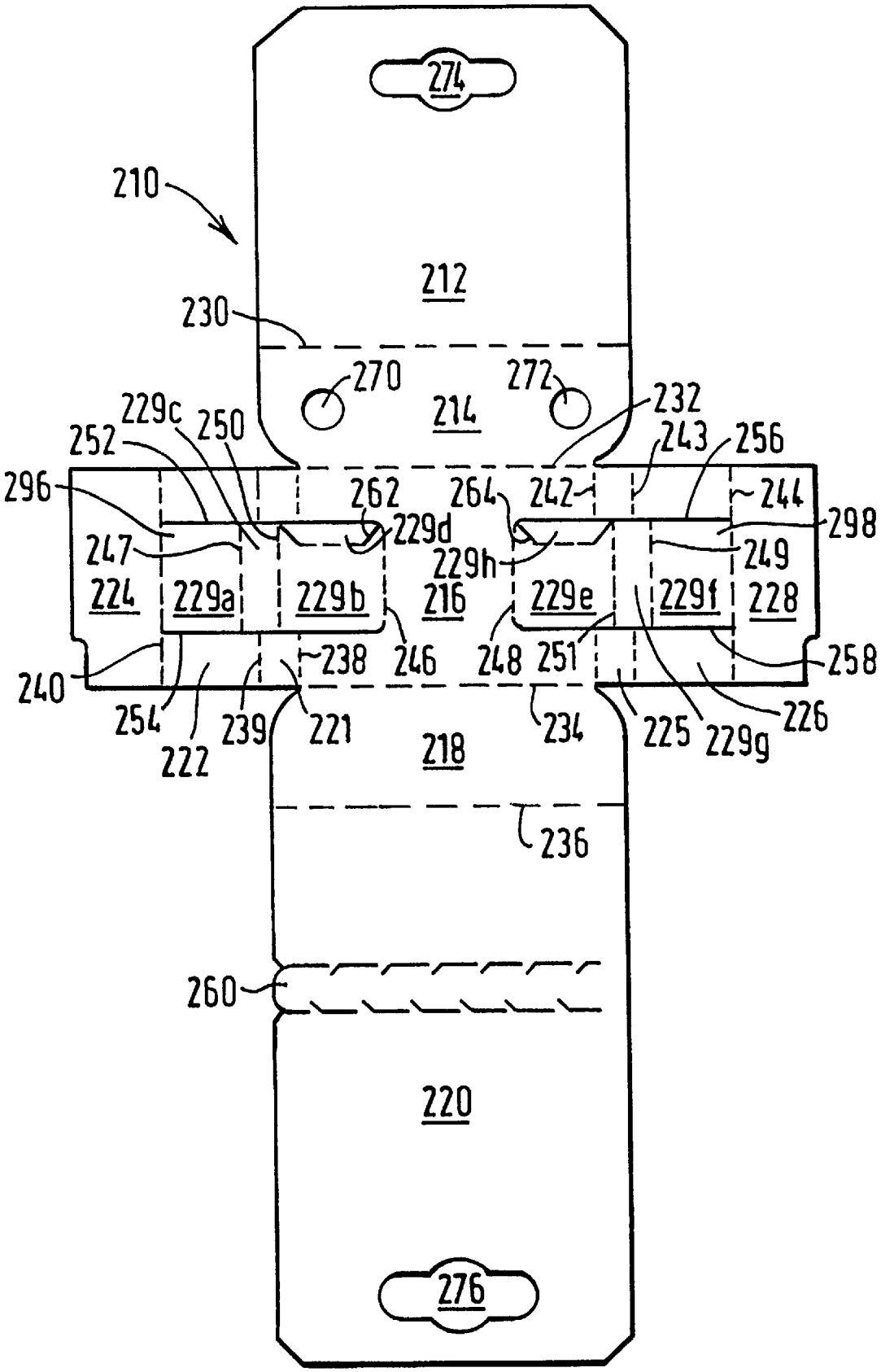
FIG. 5 is a plan view of a carton blank according to another embodiment of the invention.

Referring to FIG. 5 there is a shown a carton blank (210) made from paperboard or similar foldable sheet material. The blank comprises a series of panels hinged one to the next. Thus, support panel (212) is hingeably connected to top panel (214) along fold line (230) thereby enabling panels (212, 214) to be placed in a substantially perpendicular relationship. Top panel (214) is connected by way of fold line (232) to side panel (216), thereby enabling panels (214, 216) to be placed in a substantially perpendicular relationship. Side panel (216) is hingably connected along fold line (234) to bottom panel (218) thereby enabling panels (216, 218) to be placed in a substantially perpendicular relationship such that top panel (214) and bottom panel (218) form opposing sides in a set up carton. Base panel (218) is hingeably connected to support panel (220) by means of fold line (236) thereby enabling panels (218, 220) to be placed in a substantially perpendicular relationship. In a set up condition, support panels (212, 220) are connected together in a face to face relationship by glue or other suitable means.

Strengthening panel (224), end panel (222), intermediate panel (221) and side panel (216) are joined one to the next along fold lines (240, 239, 238) respectively. Likewise, on the opposing side of side panel (216), strengthening panel (228), end panel (226), intermediate panel (225) and side panel (216) are connected one to the next along fold lines (244, 243, 242) respectively.

In a set up condition, top panel (212), side panel (216), bottom panel (218) and a portion of support panel (220) cooperate to form a hollow display box. End and intermediate panels (221, 222, 225, 226) provide closures for the box, with strengthening panels (224, 228) being secured, such as by gluing, to support panel (220) to maintain the box in set up condition. Side panel (216) provides a display face for the package, while support panel (220) provides a back panel. As explained herein, support panels (212, 220) together cooperate to provide the panel from which the package may be hung.

Figure 6:
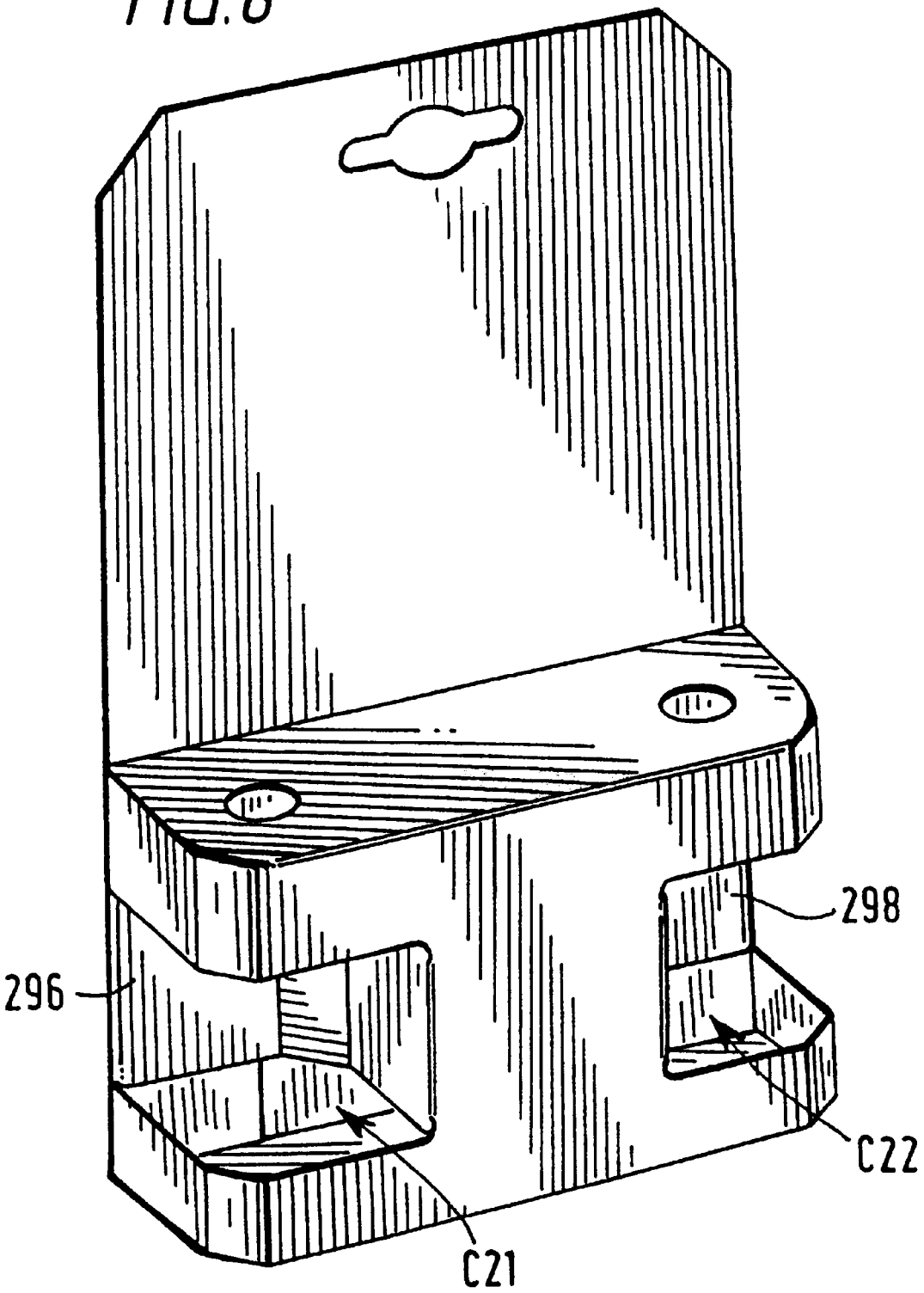
FIG. 6 is a perspective view of a carton formed from the blank shown in FIGS. 5.

The carton incorporates two securing cells or display windows (C21, C22) constructed from partition sections (296, 298) as illustrated in FIG. 6. As shown in FIG. 5, partition section (296) is struck from side panel (216) and end panel (222) along opposing cut lines (252, 254). Partition section (298) is hinged to side panel (216) along fold line (246) and hinged to strengthening panel (224) along fold line (240). When the carton is in a set up condition, this partition section will define an individual cell. Turning in more detail to partition section (296), this section comprises inner side panel (229*a*), intermediate panel (229*c*) and inner support panel (229*b*) hingably connected one to next along fold lines (247, 250) respectively. Tab (229*d*) is hingeably connected to inner support panel (229*b*) along fold line (262).

Partition section (298) is struck from side panel (216) and end panel (226) along opposing cut lines (256, 258). Partition section (298) is hinged to side panel (216) along fold line (248) and hinged to strengthening panel (228) along fold line (244). When the carton is in a set up condition this partition section will define an individual cell. Turning in more detail to partition section (298), this section comprises inner support panel (229*e*), intermediate panel (229*g*) and inner side panel (229*f*) hingeably connected one to next along fold lines (251, 249). Tabs (229*h*) is hingeably connected to inner support panel (229*g*) along fold line (264).

In order to form the carton illustrated in FIG. 6, partition section (296) is moved out of alignment with side panel (216) by folding end panel (222), intermediate panels (221, 229*c*), inner support panel (229*b*) and inner side panel (229*a*) along fold lines (238, 239, 240, 246, 247, 251).

Likewise, partition section (298) is moved out of alignment with side panel (216) by folding end panel (226), intermediate panels (225, 229*g*), inner side panel (229*f*) and inner support panel (229*e*) along fold lines (242, 243, 244, 248, 249, 251). In this embodiment, inner side panels (229*a*, 229) are positioned in a plane substantially parallel to side panel (216) and spaced therefrom by respective end and support panels (222, 229*b* and 226, 229*c*), thus forming securing cells (C21, C22) illustrated in FIG. 4.

The articles are introduced into the cells and strengthening panel (224) is folded along fold line (240) into a substantially perpendicular relationship with end panel (222). Strengthening panel (228) is also folded along fold line (244) into a perpendicular relationship with corresponding end panel (226). Strengthening panels (224, 228) are thus brought into a face to face relationship with partition sections (296, 298) respectively and are connected thereto by glue or other suitable means.

Top panel (214) is folded along fold line (232) into a substantially perpendicular relationship with side panel (216) such that apertures (270, 272) are used to secure top portions of said articles (not shown) Base panel (218) is folded along fold line (234) into a substantially perpendicular relationship with side panel (216). Thus, panels (214 & 218) are oppositely disposed so as to enclose each cell.

Support panel (220) is folded along fold line (236) into a substantially perpendicular relationship with base panel (218) and forms a face to face relationship with inner side panels (229*a*, 229). Support panel (212) is folded along fold line (230) into a substantially perpendicular relationship with top panel (214) so that it forms a face to face relationship with support panel (220) and apertures (274, 276) are in alignment as illustrated in FIG. 6.

In a set up condition, the articles are retained within the cells of the carton and can be partially viewed through the display window apertures created when partition sections (296, 298) are moved out of alignment with side panel (216) and corresponding end panels (222, 226).

Optionally, tab (260) is frangibly connected to a central portion of support panel (220). In use, this tab facilitates access to the articles retained within the cells and apertures (274, 276) allow the carrier to be hung from a hook or other suitable means.

Figure 7:
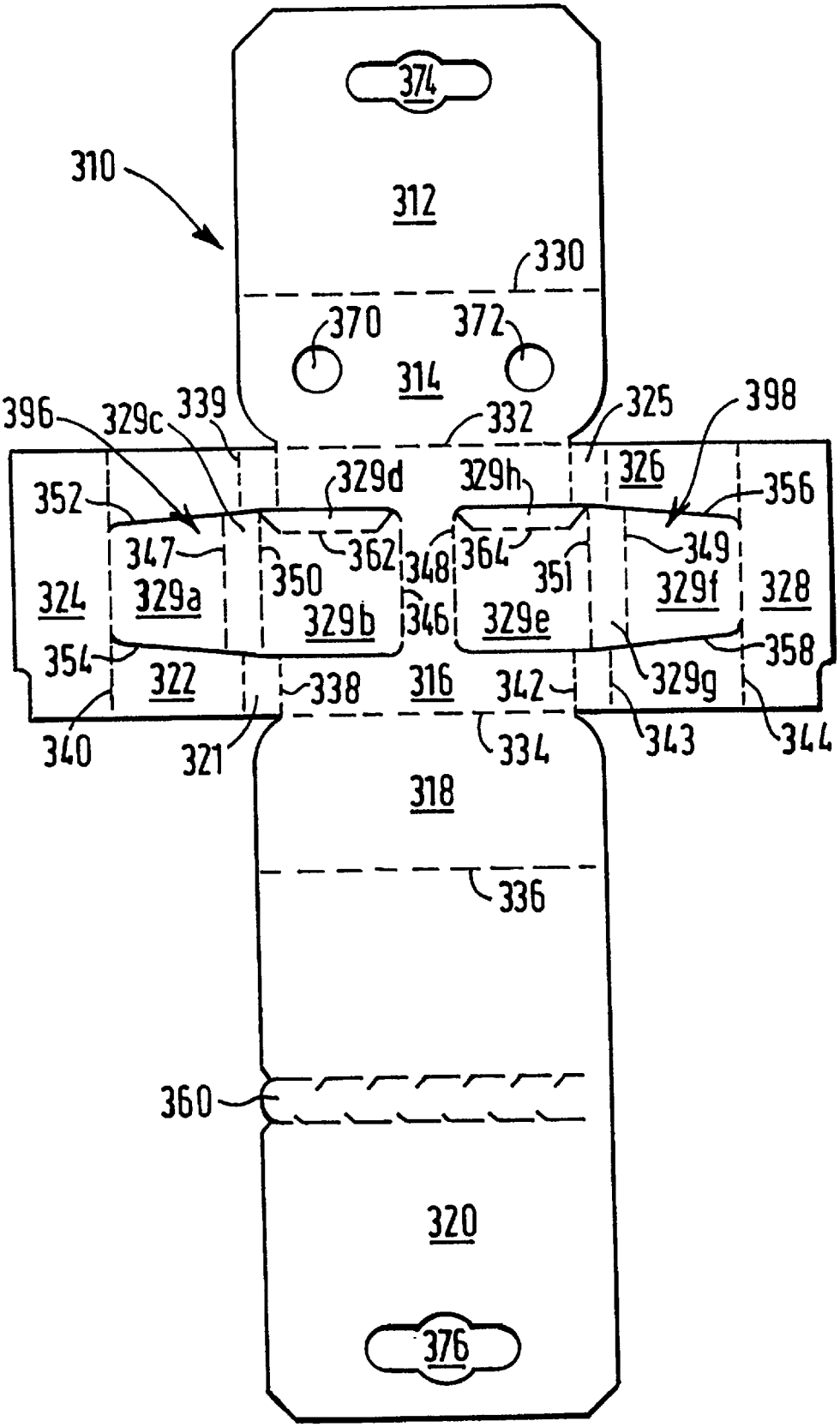
FIG. 7 is a plan view of a carton blank according to another embodiment of the invention.

Referring to FIG. 7 there is a shown a carton blank (310) made from paperboard or similar foldable sheet material. The blank comprises a series of panels hinged one to the next. Thus, support panel (312) is hingably connected to top panel (314) along fold line (330) thereby enabling panels (312, 314) to be placed in a substantially perpendicular relationship. Top panel (314) is connected by way of fold line (332) to side panel (316), thereby enabling panels (314, 316) to be placed in a substantially perpendicular relationship. Side panel (316) is hingably connected along fold line (334) to bottom panel (318) thereby enabling panels (316, 318) to be placed in a substantially perpendicular relationship such that top panel (314) and bottom panel (318) form opposing sides in a set up carton. Base panel (318) is hingeably connected to support panel (320) by means of fold line (336) thereby enabling panels (318, 320) to be placed in a substantially perpendicular relationship. In a set up condition, support panels (312, 320) are connected together in a face to face relationship by glue or other suitable means.

Strengthening panel (324), end panel (322), intermediate panel (321) and side panel (316) are joined one to the next along fold lines (340, 339, 338) respectively. Likewise, on the opposing side of side panel (316), strengthening panel (328), end panel (326), intermediate panel (325) and side panel (316) are connected one to the next along fold lines (344, 343, 342) respectively.

In a set up condition, top panel (314), side panel (316), bottom panel (318) and a portion of support panel (320) cooperate to form a hollow display box. End and intermediate panels (321, 322, 325, 326) provide closures for the box, with strengthening panels (324, 328) being secured, such as by gluing, to support panel (320) to maintain the box in set up condition. Side panel (316) provides a display face for the package, while support panel (320) provides a back panel. As explained herein, support panels (312, 320) together cooperate to provide the panel from which the package may be hung.

Figure 8:
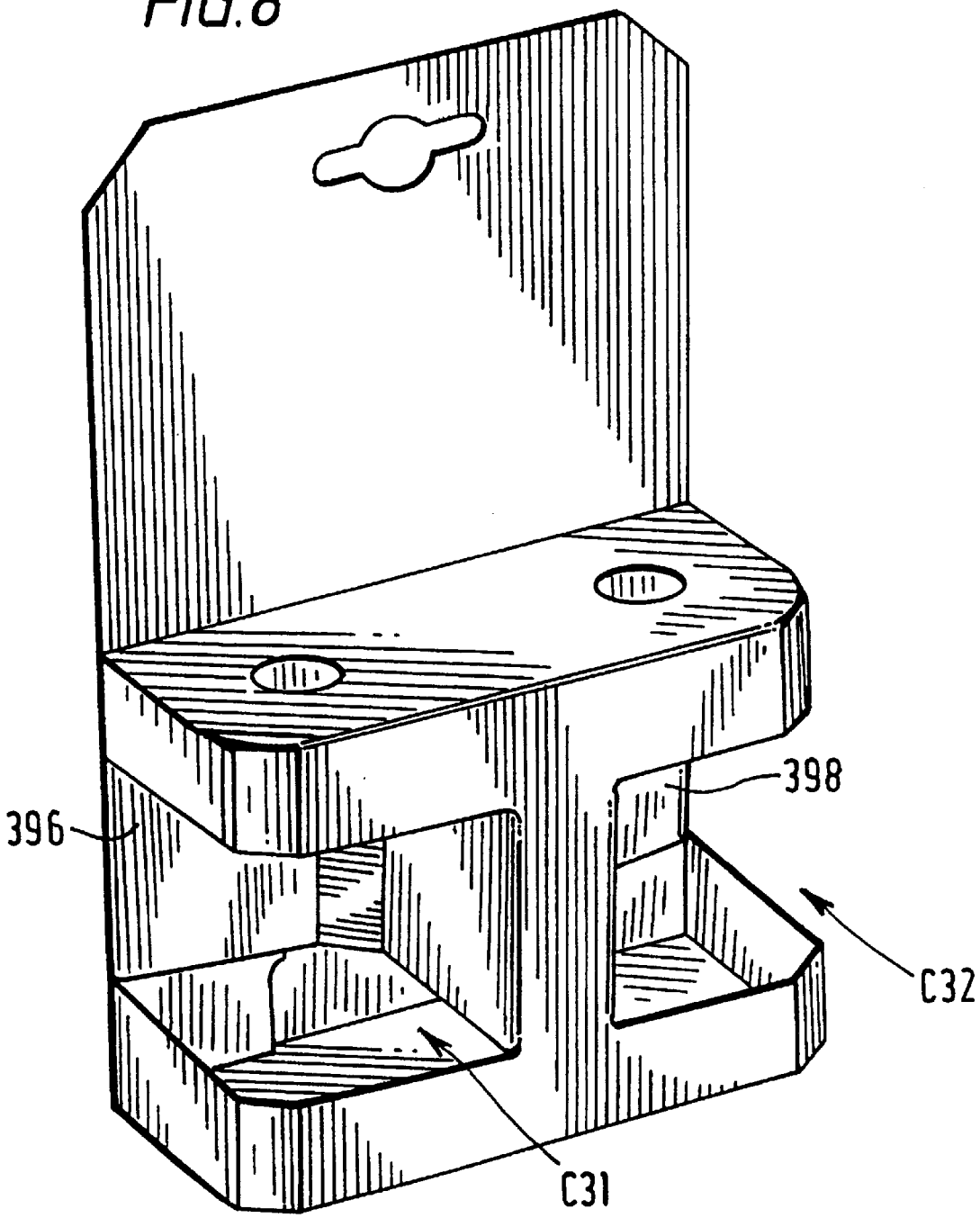
FIG. 8 is a perspective view of a carton formed from the blank shown in FIG. 7.

The carton incorporates two securing cells or display windows (C31, C32) constructed from partition sections (396, 398) as illustrated in FIG. 8. As shown in FIG. 7, partition section (396) is struck from side panel (316) and end panel (322) along opposing cut lines (352, 354). Partition section (398) is hinged to side panel (316) along fold line (346) and hinged to strengthening panel (324) along fold line (340). When the carton is in a set up condition, this partition section will define an individual cell. Turning in more detail to partition section (396), this section comprises inner side panel (329*a*), intermediate panel (329*c*) and inner support panel (329*b*) hingably connected one to next along fold lines (347, 350) respectively. Tab (329*d*) is hingeably connected to inner support panel (329*b*) along fold line (362).

Partition section (398) is struck from side panel (316) and end panel (326) along opposing cut lines (356, 358). Partition section (298) is hinged to side panel (316) along fold line (348) and hinged to strengthening panel (328) along fold line (344). When the carton is in a set up condition this partition section will define an individual cell. Turning in more detail to partition section (298), this section comprises inner support panel (329*e*), intermediate panel (329*g*) and inner side panel (329*f*) hingeably connected one to next along fold line (351, 349). Tab (329*h*) is hingeably connected to support panel (329*g*) along fold line (364).

In order to form the carton illustrated in FIG. 8, partition section (396) is moved out of alignment with side panel (316) by folding end panel (322), intermediate panels (321, 329*c*), inner support panel (329*b*) and inner side panel (329*a*) along fold lines (338, 339, 340, 346, 347, 350). Likewise, partition section (398) is moved out of alignment with side panel (316) by folding end panel (326), intermediate panels (325, 329*g*), inner side panel (329*f*) and inner support panel (329*e*) along fold lines (342, 343, 344, 348, 349, 351). In this embodiment, inner side panels (329*a*, 329) are positioned in a plane substantially parallel to side panel (316) and spaced therefrom by respective end and support panels (322, 329*b* and 326, 329*c*), thus forming securing cells (C31, C32) illustrated in FIG. 6.

The articles are introduced into the cells and strengthening panel (324) is folded along fold line (340) into a substantially perpendicular relationship with end panel (322). Strengthening panel (328) is also folded along fold line (344) into a perpendicular relationship with corresponding end panel (326). Strengthening panel (324, 328) are thus brought into a face to face relationship with partition sections (396, 398) respectively and are connected thereto by glue or other suitable means.

Top panel (314) is folded along fold line (332) into a substantially perpendicular relationship with side panel (316) such that apertures (370, 372) are used to secure top portions of said articles (not shown). Base panel (318) is folded along fold line (334) into a substantially perpendicular relationship with side panel (316). Thus, panels (314, 318) are oppositely disposed so as to enclose each cell.

Support panel (320) is folded along fold line (336) into a substantially perpendicular relationship with base panel (318) and forms a face to face relationship with inner side panels (329*a*, 329). Support panel (312) is folded along fold line (330) into a substantially perpendicular relationship with top panel (314) so that it forms a face to face relationship with support panel (320) and apertures (374, 376) are in alignment.

In a set up condition, the articles are retained within the cells of the carton and can be partially viewed through the display window apertures created when partition sections (396, 398) are moved out of alignment with side panel (316) and corresponding end panels (322, 326).

Optionally, tab (360) is frangibly connected to a central portion of support panel (320). In use, this tab facilitates access to the articles retained within the cells and apertures (374, 376) allow the carrier to be hung from a hook or other suitable means.

Figure 9:
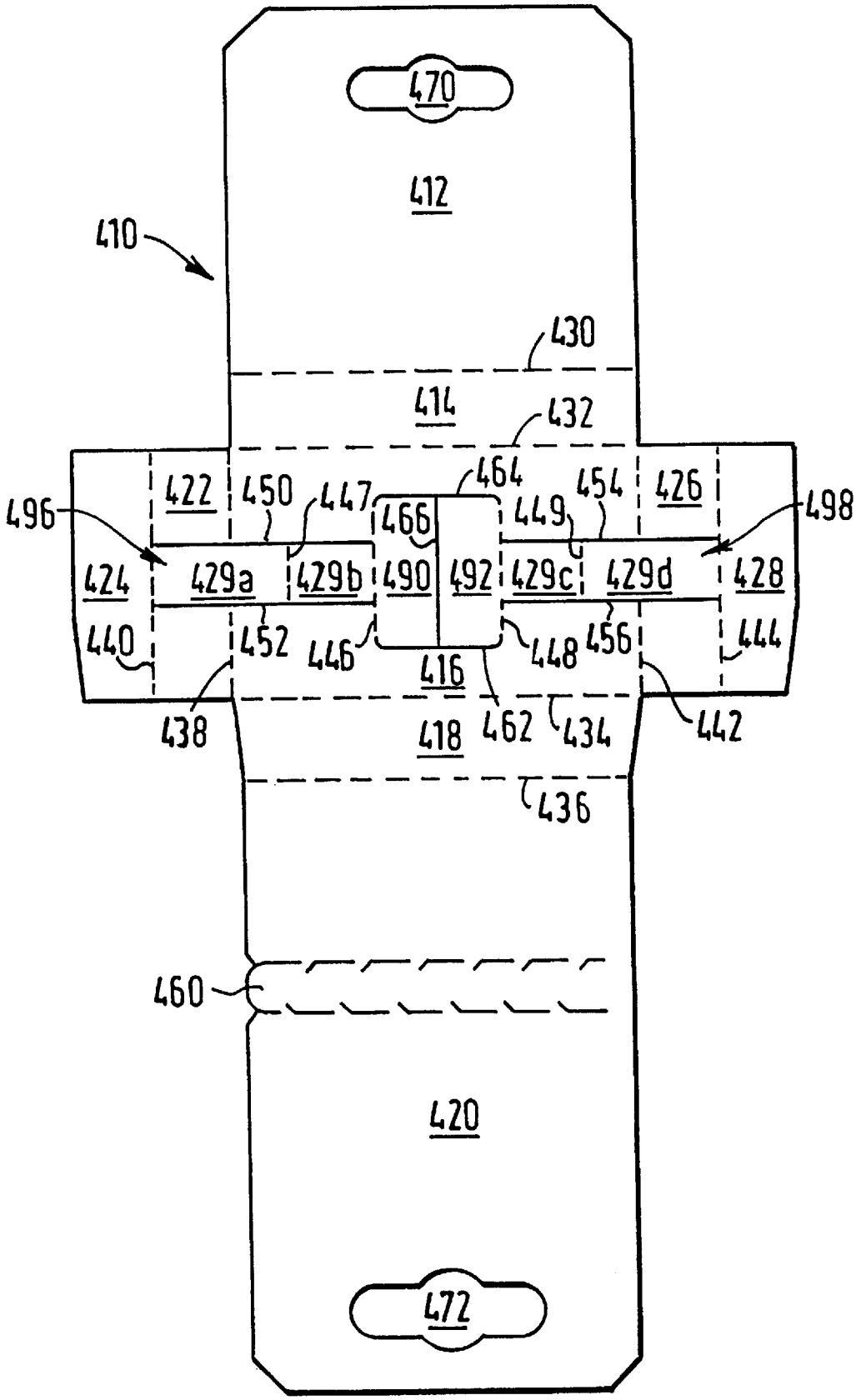
FIG. 9 is a plan view of a carton blank according to another embodiment of the invention.

Referring to FIG. 9 there is a shown a carton blank (410) made from paperboard or similar foldable sheet material. The blank comprises a series of panels hinged one to the next. Thus, support panel (412) is hingably connected to top panel (414) along fold line (430) thereby enabling panels (412, 414) to be placed in a substantially perpendicular relationship. Top panel (414) is connected by way of fold line (432) to side panel (416), thereby enabling panels (414, 416) to be placed in a substantially perpendicular relationship. Side panel (416) is hingably connected along fold line (434) to bottom panel (418) thereby enabling panels (416, 418) to be placed in a substantially perpendicular relationship such that top panel (414) and bottom panel (418) form opposing sides in a set up carton. Base panel (418) is hingeably connected to support panel (420) by means of fold line (436) thereby enabling panels (418, 420) to be placed in a substantially perpendicular relationship. In a set up condition, support panels (412, 420) are connected together in a face to face relationship by glue or other suitable means.

End panel (422) is hingably connected to side panel (416) along fold (438) and strengthening panel (424) is hingably connected by means of fold line (440) to the opposing side of end panel (422). Likewise, end panel (426) is hingably connected to side panel (416) along fold line (442) and strengthening panel (428) is hingeably connected to the opposing side of end panel (426) along fold line (444).

In a set up condition, top panel (414), side panel (416), bottom panel (418) and a portion of support panel (420) cooperate to form a hollow display box. End panels (422, 426) provide closures for the box, with strengthening panels (424, 428) being secured, such as by gluing, to support panel (420) to maintain the box in set up condition. Side panel (416) provides a display face for the package, while support panel (420) provides a back panel. As explained herein, support panels (412, 420) together cooperate to provide the panel from which the package may be hung.

Figure 10:
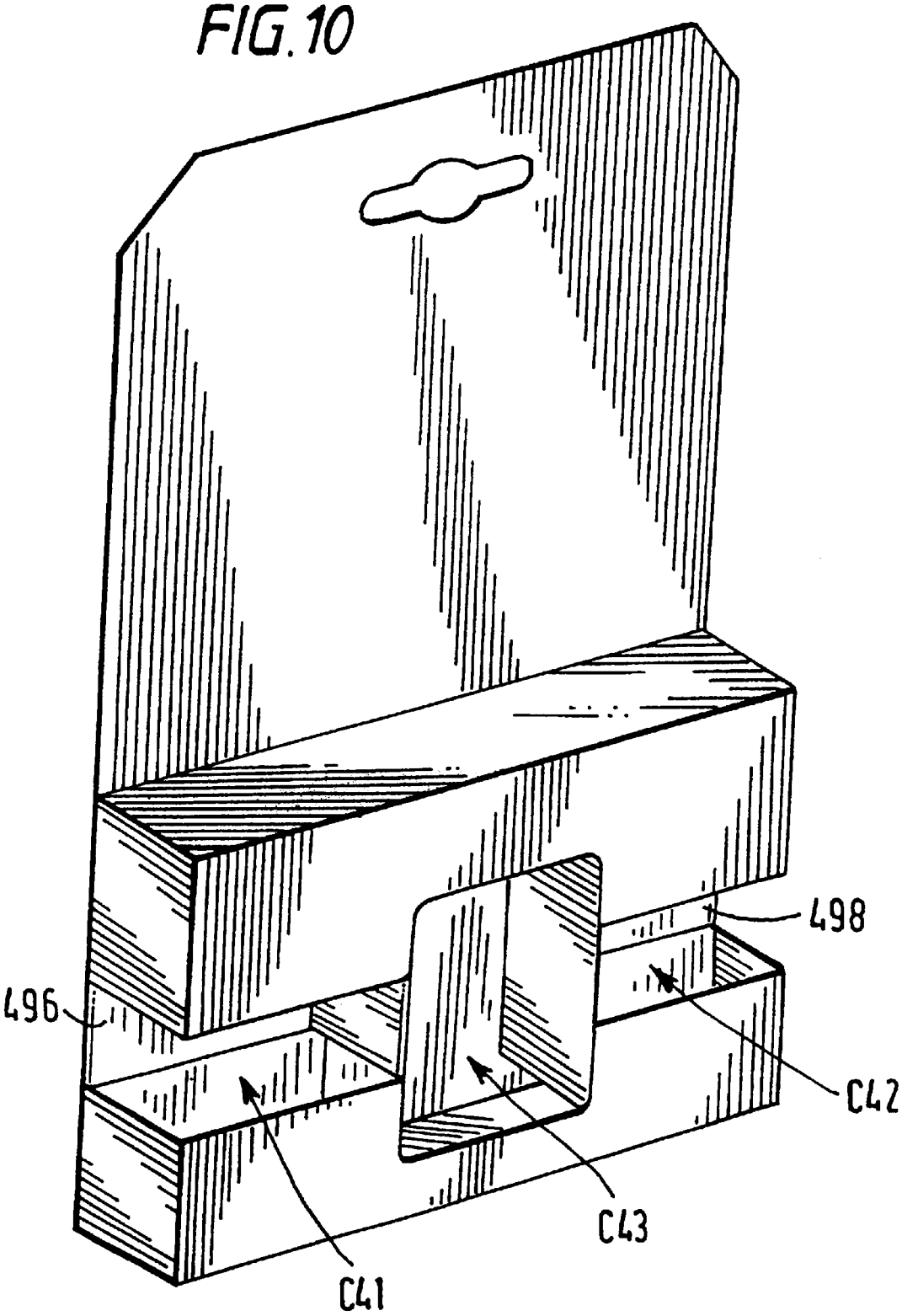
FIG. 10 is a perspective view of a carton formed from the blank shown in FIG. 9.

The carton incorporates three securing cells or display windows (C41, C42, C43) constructed from partition sections (496, 498) and tabs (490, 492) illustrated in FIG. 10. As shown in FIG. 9, partition section (496) is struck from side panel (416) and end panel (422) along opposing cut lines (450, 452). Partition section (496) is hinged to side panel (416) along fold line (446) and hinged to strengthening panel (424) along fold line (440). Turning in more detail to partition section (496), this section comprises inner side panel (429*a*) and inner support panel (429*b*) hingably connected together along fold line (447) to define cell (C41). Tab (490) is hingeably connected to side panel (416) along fold line (446) and is separable from said panel by cut lines (462, 464). When the carton is in a set up condition, partition section (496) supports tab (490); the tab (490) defining one side of the cell (C42).

Partition section (498) is struck from side panel (416) and end panel (426) along opposing cut lines (454, 456). Partition section (498) is hinged to side panel (416) along fold line (448) and hinged to strengthening panel (428) along fold line (444). Turning in more detail to partition section (498), this section comprises inner support panel (429) and inner side panel (429*d*) hingeably connected together along fold line (448) to define cell C43. Tab (492) is hingeably connected to side panel (416) along fold line (446) and is separable from said panel by cut lines (462, 464). When the carton is in a set up condition, partition section (498) supports tab (492); the tab (492) defining the opposite side of the cell (C42).

In order to form the carton illustrated in FIG. 10, partition section (496) is moved out of alignment with side panel (416) by folding end panel (422), inner support panel (429*b*) and inner side panel (429*a*) along fold lines (438, 440, 446, 447). Likewise, partition section (498) is moved out of alignment with side panel (416) by folding end panel (426), inner side panel (429*a*) and inner support panel (429*c*) along fold lines (442, 444, 448, 449). In this embodiment, inner side panels (429*a*, 429*d*) are positioned in a plane substantially parallel to side panel (416) and spaced therefrom by end panels (422, 429*b* and 426, 429*c*). Tabs (490, 492) are folded into a face to face relationship with the respective inner support panel (429*b*, 429*c*). Thus, securing cells (C41, C42, C43) are formed as shown in FIG. 10.

The articles are introduced into one or more of the cells and strengthening panel (424) is folded along fold line (440) into a substantially perpendicular relationship with end panel (422). Strengthening panel (428) is also folded along fold line (444) into a perpendicular relationship with corresponding end panel (426). Strengthening panels (424, 428) are thus brought into a face to face relationship with partition sections (496, 498) respectively and are connected thereto by glue or other suitable means.

Top panel (414) is folded along fold line (432) into a substantially perpendicular relationship with side panel (416) such that apertures (470, 472) are used to secure top portions of said articles (not shown). Base panel (418) is folded along fold line (434) into a substantially perpendicular relationship with side panel (416). Thus, panels (414, 418) are oppositely disposed so as to enclose each cell.

Support panel (420) is folded along fold line (436) into a substantially perpendicular relationship with base panel (418) and forms a face to face relationship with inner side panels (429*a*, 429). Support panel (412) is folded along fold line (430) into a substantially perpendicular relationship with top panel (414) so that it forms a face to face relationship with support panel (420) and apertures (474, 476) are in alignment.

In a set up condition, the articles are retained within the cells of the carton and can be partially viewed through the display window apertures created when partition sections (496, 498) are moved out of alignment with side panel (416) and corresponding end panel (422, 426).

Optionally, tab (460) is frangibly connected to a central portion of support panel (420). In use, this tab facilitates access to the articles retained within the cells and apertures (470, 472) allow the carrier to be hung from a hook or other suitable means.

Figure 11:
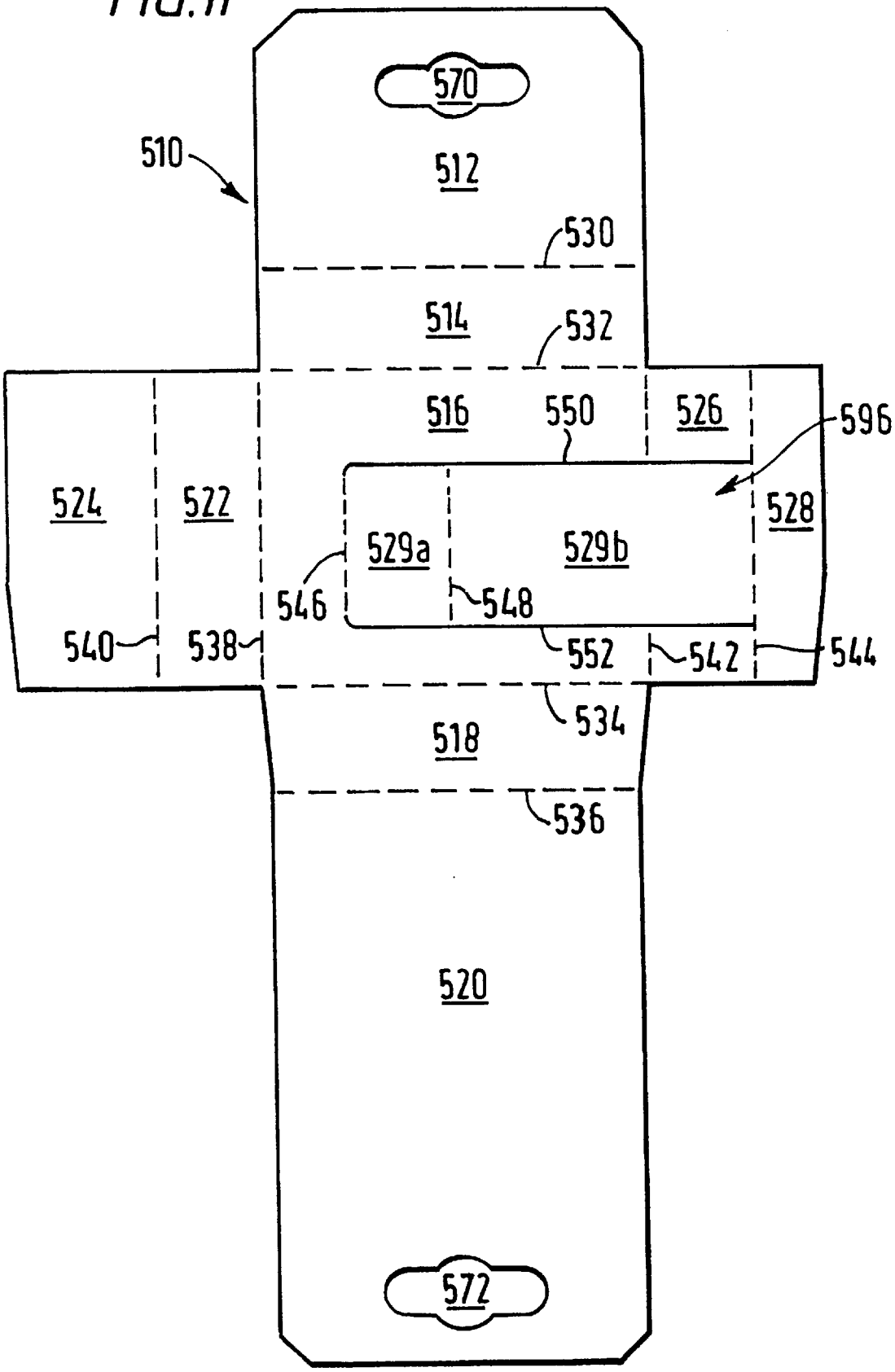
FIG. 11 is a plan view of a carton blank according to another embodiment of the invention.

Referring to FIG. 11 there is a shown a carton blank (510) made from paperboard or similar foldable sheet material.

The blank comprises a series of panels hinged one to the next. Thus, support panel (512) is hingably connected to top panel (514) along fold line (530) thereby enabling panels (512, 514) to be placed in a substantially perpendicular relationship. Top panel (514) is connected by way of fold line (532) to side panel (516), thereby enabling panels (514, 516) to be placed in a substantially perpendicular relationship. Side panel (516) is hingably connected along fold line (534) to bottom panel (518) thereby enabling panels (516, 518) to be placed in a substantially perpendicular relationship such that top panel (514) and bottom panel (518) form opposing sides in a set up carton. Base panel (518) is hingeably connected to support panel (520) by means of fold line (536) thereby enabling panels (518, 520) to be placed in a substantially perpendicular relationship. In a set up condition support panels (512, 520) are connected together in a face to face relationship by glue or other suitable means.

End panel (522) is hingably connected to side panel (516) along fold (538) and strengthening panel (524) is hingably connected by means of fold line (540) to the opposing side of end panel (522). Likewise, end panel (526) is hingably connected to side panel (516) along fold line (542) and strengthening panel (528) is hingeably connected to the opposing side of end panel (526) along fold line (544).

In a set up condition, top panel (514), side panel (516), bottom panel (518) and a portion of support panel (520) cooperate to form a hollow display box. End panels (522, 526) provide closures for the box, with strengthening panel (524, 528) being secured, such as by gluing, to support panel (520) to maintain the box in set up condition. Side panel (516) provides a display face for the package, while support panel (520) provides a back panel. As explained herein, support panels (512, 520) together cooperate to provide the panel from which the package may be hung.

Figure 12:
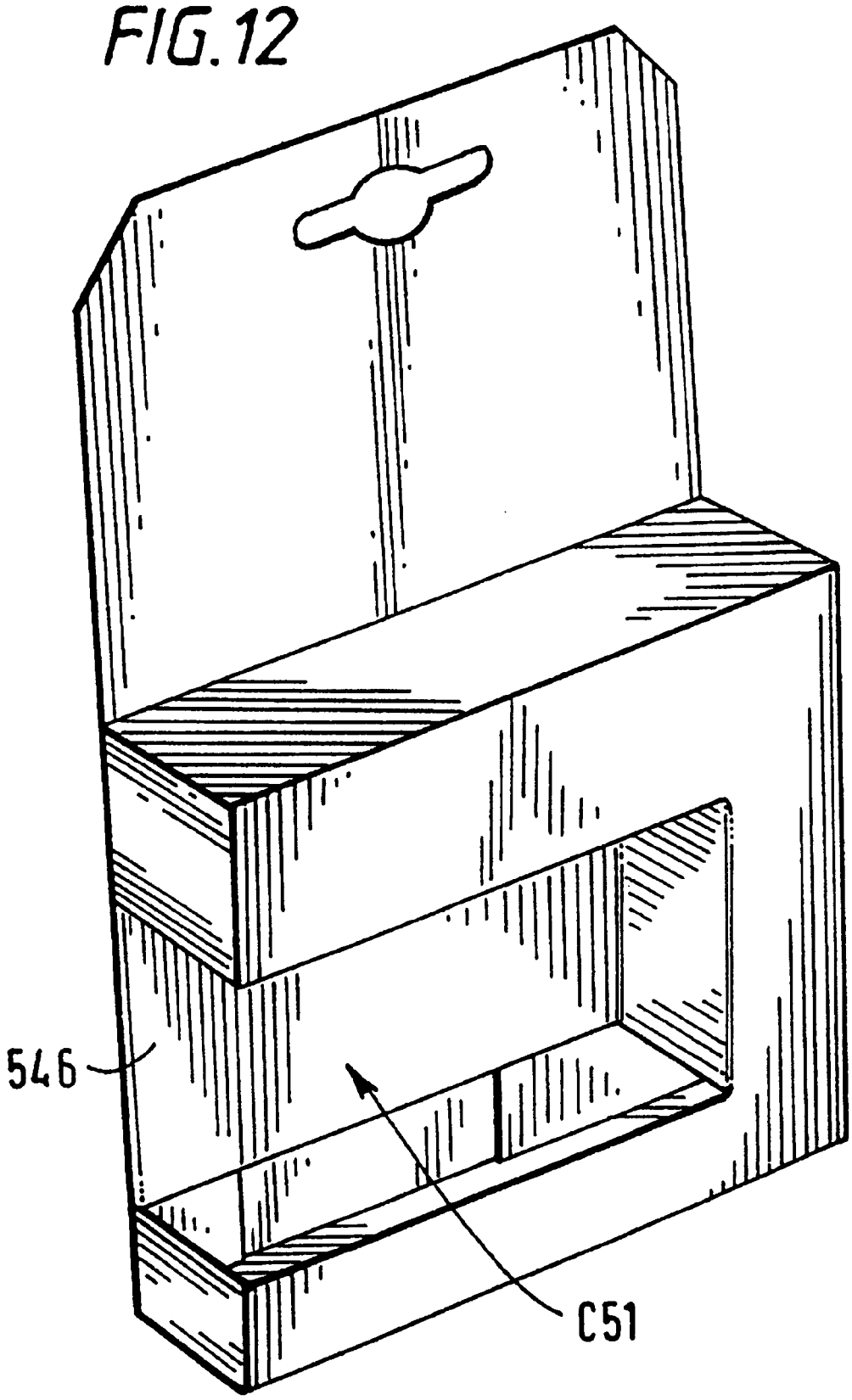
FIG. 12 is a perspective view of a carton formed from the blank shown in FIG. 11.

The carton incorporates a single securing cell or display window (C51) constructed from partition section (546) as illustrated in FIG. 12. Partition section (546) is struck from side panel (516) and end panel (526) along opposing cut lines (550, 552). Partition section (546) is hinged to side panel (516) along fold line (546) and hinged to strengthening panel (528) along fold line (544). When the carton is in a set up condition this partition section will define the individual cell.

Turning in more detail to partition section (546), this section comprises inner support panel **(529*a*) and inner side panel (529*b*) hingeably connected together along fold line (548)**.

In order to form the carton illustrated in FIG. 12, partition section (546) is moved out of alignment with side panel (516) by folding end panel (526), inner side panel **(529*b*) and inner support panel (529*b*) along fold lines (542, 544, 546, 548). In this embodiment, inner side panel (529*a*) is positioned in a plane substantially parallel to side panel (516) and spaced therefrom by end and inner support panels (526, 529*a*), thus forming securing cell (C51) illustrated in FIG. 12**.

The article is introduced into the cell and strengthening panel (524) is folded along fold line (540) into a substantially perpendicular relationship with end panel (522). Strengthening panel (528) is also folded along fold line (544) into a perpendicular relationship with corresponding end panel (526). Strengthening panel (524, 528) are thus brought into a face to face relationship with partition section (596) and are connected thereto by glue or other suitable means.

Top panel (514) is folded along fold line (532) into a substantially perpendicular relationship with side panel (516). Base panel (518) is folded along fold line (534) into a substantially perpendicular relationship with side panel (516). Thus, panels (514, 518) are oppositely disposed so as to enclose each cell.

Support panel (520) is folded along fold line (536) into a substantially perpendicular relationship with base panel (518) and forms a face to face relationship with inner side panels **(529*a*, 529*c*). Support panel (512) is folded along fold line (530) into a substantially perpendicular relationship with top panel (514) so that it forms a face to face relationship with support panel (520)**.

In a set up condition, the articles are retained within the cells of the carton and can be partially viewed through the display window aperture created when partition sections (596, 598) are moved out of alignment with side panel (516) and corresponding end panel (522, 526).

Optionally, tab (not shown) is frangibly connected to a central portion of support panel (520). In use, this tab facilitates access to the article retained within the cell and apertures (570, 572) allow the carrier to be hung from a hook or other suitable means.

We claim:

1. A display package formed from a blank said package comprising:

top and bottom panels interconnected by front and back opposed side panels to form a hollow box structure;

an end panel connected to a side edge of said front side panel by first hingable means; and first means for defining a first display window in said front side panel and said end panel, said first defining means comprising a first displaceable panel formed at least in part from said front side panel and a second displaceable panel formed at least in part from said end panel and foldably connected to said first displaceable panel by second hingable means, said first defining means being displaced to define said window to an internal position where said first and second displaceable panels define a cell for receiving at least one article, wherein said first and second hingable means are offset from each other when said package is in a form of said blank, wherein said first hingable means comprises a first bevelled corner panel foldably interconnecting said front side panel and said end panel, and said second hingable means comprises a second bevelled corner panel foldably interconnecting said first and second displaceable panels.

2. The display package according to claim 1 wherein said second displaceable panel is secured to said back side panel.

3. A display package formed from a blank, said package comprising:

top and bottom panels interconnected by front and back opposed side panels to form a hollow box structure;

an end panel connected to a side edge of said front side panel by first hingable means;

first means for defining a first display window in said front side panel and said end panel, said first defining means comprising a first displaceable panel formed at least in part from said front side panel and a second displaceable panel formed at least in part from said end panel and foldably connected to said first displaceable panel by second hingable means, said first defining means being displaced to define said window to an internal position where said first and second displaceable panels define a cell for receiving at least one article, wherein said first and second hingable means are offset from each other when said package is in a form of said blank; and second means for defining a second display window in said front side panel, said second defining means comprising at least one tab formed from and foldably connected to said front side panel.

4. A blank for forming a display package, comprising:

an interconnected series of panels including a top panel, a front side panel, a bottom panel, a back side panel;

an end panel connected to a side edge of said front side panel by first hingable means; and means for defining a display window in said front side panel and said end panel, said defining means comprising a first displaceable panel formed at least in part from said front side panel and a second displaceable panel formed at least in part from said end panel and foldably connected to said first displaceable panel by second hingable means offset from said first hingable means, whereby upon folding of said end panel about said first hingable means, said defining means is displaced to an internal position where said first and second displaceable panels define a cell for receiving at least one article, wherein said first hingable means comprises a first bevelled comer panel foldably interconnecting said front side panel and said end panel, and said second hingable means comprises a second bevelled corner panel foldably interconnecting said first and second displaceable panels.

5. The blank according to claim 4 further comprising a strengthening panel connected to an outer edge of said end panel.

6. The blank according to claim 4 wherein said back side panel is of a length greater than said front side panel.

7. The blank according to claim 6 further comprising a front support panel connected to said top panel, and wherein said length of said back side panel is generally equal to a combined length of said front side panel and said front support panel.

8. A carton comprising:

a plurality of carton walls hingably interconnected in series to form a tubular structure;

an end closure structure having a free end and an opposed end and hingably connected at said opposed end to one of said carton walls to at least partially close an open end of said tubular structure; and an internal partition formed from said end closure structure and said one carton wall and hingably connected at opposite ends thereof respectively to said end closure structure and said one carton wall;

wherein said internal partition is folded with respect to said end closure structure and to said one carton wall such that said internal partition is disposed internally of said tubular structure to define a cell for receiving an article.

9. The carton according to claim 8 wherein said internal partition comprises a first displaceable panel formed at least in part from said one carton wall and a second displaceable panel formed at least in part from said end closure structure and foldably connected to said first displaceable panel by hingable means.

10. The carton according to claim 8 wherein said internal partition is defined between a pair of opposed cut lines each emanating from said end closure structure and extended into said one carton wall.

11. The carton according to claim 8 wherein said internal partition is folded inwardly of said tubular structure to define a window in said one carton wall and said end closure structure.

12. The carton according to claim 9 wherein said hingable means comprises a fold line dividing said internal partition into said first and second displaceable panels, said first displaceable panel extending between said fold line and one of said opposite ends of said internal partition, said second displaceable panel extending between said fold line and the other of said opposite ends.

13. The carton according to claim 9 wherein said hingable means comprises a beveled comer panel foldably interconnecting said first and second displaceable panels, said first displaceable panel extending between said comer panel and one of said opposite ends of said internal partition, said second displaceable panel extending between said corner panel and the other of said opposite ends.

14. The carton according to claim 8 wherein said end closure structure comprises an end panel and a strengthening panel hingably connected to said end panel along a fold line, said end panel extending between said fold line and said opposed end of said end closure structure, said strengthening panel extending between said fold line and said free end of said end closure structure, and one of said opposite ends of said internal partition is hingably connected to said strengthening panel.

15. The carton according to claim 8 further comprising means for suspending said tubular structure therefrom, said suspending means comprising a support panel hingably connected to said tubular structure.

16. The carton according to claim 8 wherein said tubular structure comprises a top wall disposed in perpendicular relationship with said one carton wall, said top wall having an aperture for securing a top portion of said article.

17. A package comprising a carton and an article accommodated in said carton, said carton comprising:

a plurality of carton walls hingably interconnected in series to form a tubular structure;

an end closure structure having a free end and an opposed end and hingably connected at said opposed end to one of said carton walls to at least partially close an open end of said tubular structure; and an internal partition formed from said end closure structure and said one carton wall and hingably connected at opposite ends thereof respectively to said end closure structure and said one carton wall;

wherein said internal partition is folded with respect to said end closure structure and to said one carton wall such that said internal partition is disposed internally of said tubular structure to define a cell, and said article is received in said cell.

* * * * *